US008096247B2

(12) United States Patent
Monroe et al.

(10) Patent No.: US 8,096,247 B2
(45) Date of Patent: Jan. 17, 2012

(54) SYSTEM AND METHOD FOR TUFTING MULTIPLE FABRICS

(75) Inventors: Charles F. Monroe, Ringgold, GA (US); Marshal Allen Neely, Jr., Soddy Daisy, GA (US); William M. Christman, Jr., Chattanooga, GA (US)

(73) Assignee: Card-Monroe Corp., Hixson, TN (US)

( * ) Notice: Subject to any disclaimer, the term of this patent is extended or adjusted under 35 U.S.C. 154(b) by 705 days.

(21) Appl. No.: 12/260,213

(22) Filed: Oct. 29, 2008

(65) Prior Publication Data

US 2009/0107372 A1 Apr. 30, 2009

Related U.S. Application Data

(60) Provisional application No. 60/983,454, filed on Oct. 29, 2007.

(51) Int. Cl.
*D05C 15/26* (2006.01)
*G06F 9/44* (2006.01)

(52) U.S. Cl. ..... 112/80.43; 112/470.01; 112/475.08; 700/137

(58) Field of Classification Search ..... 700/136–138; 112/80.01–80.54, 470.01, 475.08, 475.17
See application file for complete search history.

(56) References Cited

U.S. PATENT DOCUMENTS

| | | | | |
|---|---|---|---|---|
| 2,990,792 | A | 7/1961 | Nowicki et al. | |
| 3,172,380 | A * | 3/1965 | Boyles | 112/80.23 |
| 3,375,797 | A | 4/1968 | Gaines | |
| 3,485,195 | A | 12/1969 | Torrence | |
| 3,502,044 | A * | 3/1970 | James et al. | 112/80.23 |
| 3,618,542 | A | 11/1971 | Zocher | |
| 3,709,173 | A | 1/1973 | Greene | |
| 3,757,709 | A | 9/1973 | Cobble | |
| 3,835,797 | A | 9/1974 | Franks et al. | |
| 3,847,098 | A | 11/1974 | Hammel, Jr. | |
| 3,919,953 | A | 11/1975 | Card et al. | |
| 4,103,629 | A | 8/1978 | Card | |
| 4,106,416 | A | 8/1978 | Blackstone, Jr. et al. | |
| 4,134,348 | A | 1/1979 | Scott | |
| 4,138,956 | A | 2/1979 | Parsons | |
| 4,155,319 | A | 5/1979 | Short | |
| 4,170,949 | A | 10/1979 | Lund | |

(Continued)

FOREIGN PATENT DOCUMENTS

GB 2050447 A 1/1981

(Continued)

OTHER PUBLICATIONS

International Search Report and Written Opinion for Application No. PCT/US2008/081527, mailed Feb. 18, 2009.

*Primary Examiner* — Ismael Izaguirre
(74) *Attorney, Agent, or Firm* — Womble Carlye Sandridge & Rice, LLP

(57) ABSTRACT

A system for forming multiple patterned, tufted articles, includes a tufting machine having a series of distinct machine sections each adapted to form a desired patterned, tufted articles and each operable independently of the other machine sections. A system control can be programmed with pattern parameters for each of the patterned tufted articles to be formed, and will control the machine sections to form each of the patterned tufted articles.

15 Claims, 7 Drawing Sheets

U.S. PATENT DOCUMENTS 4,185,569 A 1/1980 Inman
4,193,358 A 3/1980 Woodcock
4,195,580 A 4/1980 Hurst
4,313,388 A 2/1982 Biggs et al.
4,353,317 A 10/1982 Crumbliss
4,366,761 A 1/1983 Card
4,369,720 A 1/1983 Beasley
4,393,793 A 7/1983 Beasley
4,397,249 A 8/1983 Slattery
4,419,944 A 12/1983 Passons et al.
4,440,102 A 4/1984 Card et al.
4,466,366 A 8/1984 Hirotsu
4,522,132 A 6/1985 Slattery
4,557,208 A 12/1985 Ingram et al.
4,574,716 A 3/1986 Czelusniak, Jr.
4,619,212 A 10/1986 Card et al.
4,630,558 A 12/1986 Card et al.
4,637,329 A 1/1987 Czelusniak, Jr.
4,667,611 A 5/1987 Yamamoto et al.
4,688,497 A 8/1987 Card et al.
4,815,403 A 3/1989 Card et al.
4,831,948 A * 5/1989 Itoh et al. ..... 112/80.43
4,836,118 A 6/1989 Card et al.
4,841,886 A 6/1989 Watkins
4,849,270 A 7/1989 Evans et al.
4,856,441 A 8/1989 Kurata
4,860,674 A 8/1989 Slattery
4,864,946 A 9/1989 Watkins
4,903,624 A 2/1990 Card et al.
4,903,625 A 2/1990 Card et al.
5,005,498 A * 4/1991 Taylor et al. ..... 112/80.32
5,058,518 A 10/1991 Card et al.
5,094,178 A 3/1992 Watkins
5,182,997 A 2/1993 Bardsley
5,224,434 A 7/1993 Card et al.
5,383,415 A 1/1995 Padgett, III
5,544,605 A 8/1996 Frost
5,575,228 A 11/1996 Padgett et al.
5,588,383 A 12/1996 Davis et al.
5,622,126 A 4/1997 Card et al.
5,743,201 A 4/1998 Card et al.
5,899,152 A 5/1999 Bardsley et al.
5,954,003 A 9/1999 Beyer et al.
5,983,815 A 11/1999 Card
6,009,818 A 1/2000 Card et al.
6,155,187 A 12/2000 Bennett et al.
6,244,203 B1 6/2001 Morgante et al.
6,263,811 B1 7/2001 Crossley
6,283,053 B1 9/2001 Morgante et al.
6,439,141 B2 8/2002 Morgante et al.
6,446,566 B1 9/2002 Bennett et al.
6,502,521 B2 1/2003 Morgante et al.
6,508,185 B1 1/2003 Morgante et al.
6,516,734 B1 2/2003 Morgante et al.
6,550,407 B1 4/2003 Frost et al.
6,758,154 B2 7/2004 Johnston
6,807,917 B1 10/2004 Christman et al.
6,834,601 B2 12/2004 Card et al.
6,834,602 B1 12/2004 Hall
6,874,437 B2 * 4/2005 Kim ..... 112/102.5
6,983,192 B2 * 1/2006 Block et al. ..... 700/138
7,216,598 B1 5/2007 Christman, Jr.
7,252,044 B2 * 8/2007 Lee ..... 112/102.5
7,296,524 B2 11/2007 Beverly
7,350,443 B2 4/2008 Oakey et al.
7,431,974 B2 10/2008 Lovelady et al.
7,490,566 B2 2/2009 Hall
2004/0187268 A1 9/2004 Johnston
2007/0272137 A1 11/2007 Christman et al.

FOREIGN PATENT DOCUMENTS

GB 2115025 A 9/1983
GB 2446371 A 1/1992
WO WO84/00388 2/1984

* cited by examiner

SYSTEM AND METHOD FOR TUFTING MULTIPLE FABRICS

CROSS REFERENCE TO RELATED APPLICATION

The present patent application is a formalization of previously filed, co-pending U.S. Provisional Patent Application Ser. No. 60/983,454, filed Oct. 29, 2007 by the inventor named in the present Application. This patent application claims the benefit of the filing date of this cited Provisional Patent Application according to the statutes and rules governing provisional patent applications, particularly 35 U.S.C. §119(a)(i) and 36 C.F.R. §1.78(a)(4) and (a)(5). The specification and drawings of the Provisional Patent Application referenced above are specifically incorporated herein by reference as if set forth in their entirety.

FIELD OF THE INVENTION

The present invention generally relates to tufting carpets and other fabric products, and in particular to a system and method for tufting different products in different zones or sections of a tufting machine.

BACKGROUND OF THE INVENTION

Carpets and other tufted articles generally are formed by passing a backing material through a tufting machine in which a series of needles are reciprocated so as to deliver tufts of yarn into the backing material. Over the years, tufting machines have been further developed and provided with various enhancements designed to produce new and more varied pattern effects, such as cut and loop pile patterns, shifting needle bar patterns, as well as producing different tufted fabrics, such as synthetic or artificial grass turf products and patterned rugs.

A problem that exists, however, with the formation of specialty products such as carpet tiles and narrower or smaller rugs or carpets, is that such products often typically are run on specialty machines that are smaller in size, which can limit production rates. Running such products on larger, full-sized tufting machines also can require additional operations to separate or form the tiles or rugs from the full-sized tufted fabrics, and generally limits the type of patterns that can be formed across the width of the tufted fabrics to a single pattern.

Therefore, it can be seen that a needs exists for a system and method for forming tufted carpets and other, similar tufted fabrics that addresses the foregoing and other related and related problems in the art.

SUMMARY OF THE INVENTION

Briefly described, the present invention generally is directed to a system and method for tufting or otherwise forming multiple tufted fabric articles or products, such as carpets, including tufted fabrics having different patterns or pattern effects, which patterns can be formed at substantially the same time utilizing a single tufting machine. The tufting machine generally will include a frame, with two or more machine sections or pattern sections defined transversely thereacross, and with each of the machine or pattern sections defining a tufting zone. Each machine or pattern section generally will include one or more needle bars, which can be shiftable, and which include needles spaced therealong and arranged either inline or in staggered series. Additionally, each machine or pattern section typically will include a yarn feed mechanism or device associated therewith for controlling the feeding of yarns to the needles of such machine or pattern section. Each tufting machine section further can have a main drive shaft associated therewith for driving its needle bar(s), or the needle bars of each machine section can be run off of a single main drive shaft for the tufting machine.

Still further, the tufting machine generally will include a series of backing feed rolls, including at least one upstream and one downstream backing feed roll for feeding a backing material through the tufting machine. Multiple sets or pairs of backing feed rolls also can be used, with each machine or pattern section having a set for backing feed rolls associated therewith. Thus, either a single backing material web can be fed substantially simultaneously through all of the tufting zones of each of the machine or pattern sections of the tufting machine, or, alternatively, multiple sets or pairs of backing feed rolls can feed multiple, separate lengths or webs of backing materials independently through each of the machine or pattern sections.

The tufting machine further will be operated under control of a system control that is capable of operating each of the machine or pattern sections independently as needed for forming the desired multiple tufted fabrics or articles with various different pattern effects, including different pile heights, pile types, such as mixtures of cut and loop tufts, various yarn feed pattern effects, and the like. The system control can include an overall tufting machine control system such as a "Command-Performance™" computerized tufting machine control system, as manufactured by Card-Monroe Corp., or can include a stand-alone workstation or system controller that operates in conjunction with a tufting machine controller for controlling various operative features of the tufting machine. The system control further can include design center functionality to enable an operator to design or create various pattern effects to be run by each of the machine or pattern sections.

In operation of the system and method for forming multiple tufted fabric articles or products according to the principles of the present invention, an operator can select a desired machine or pattern section, and thereafter will input various pattern parameters, including yarn feed rates or amounts for each color or step of the pattern, a cloth feed or stitch rate, if needed, shift steps for the pattern, and further can adjust or set needle strokes and bed rail positions for the pattern. The operator generally will repeat this process for each pattern or machine section in which different patterns are to be run, or alternatively, can select from preprogrammed patterns and assign such preprogrammed pattern information to a selected machine or pattern section. After all of the machine or pattern sections to be run have been assigned their pattern instructions, the tufting machine can be initiated to begin tufting operations. The tufting machine sections or pattern sections will be independently operated by the system control so as to tuft the desired or programmed patterns therefore. Each machine or pattern section is operated until the desired amount or run of the tufted article or fabric is completed.

Various features, objects and advantages of the present invention will become apparent to those skilled in the art upon a review of the following detailed description, when taken in conjunction with the company drawings.

DETAILED DESCRIPTION OF THE INVENTION

Figure 1:
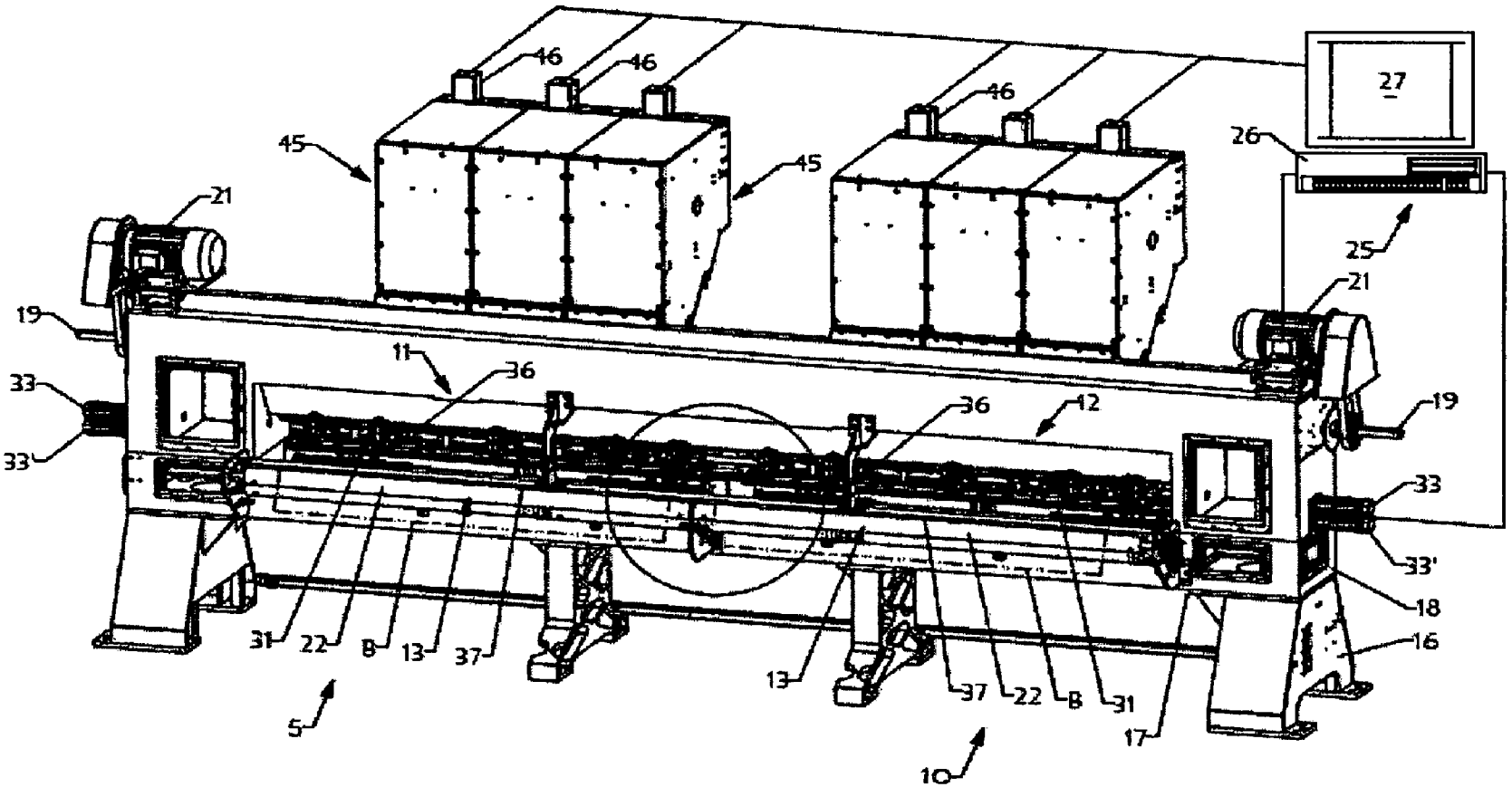
FIG. 1 is a perspective illustration of one embodiment of a tufting machine for forming multiple tufted fabrics according to the principles of the present invention.

Referring now to the drawings, FIGS. 1-7 generally illustrate a system 5 and method according to the principles of the present invention for forming multiple tufted fabric products such as carpets, including tufted fabrics having different patterns that can be formed at substantially the same time on a single tufting machine 10. As indicated in FIGS. 1-2 and 4-5, the tufting machine according to the present invention will include two or more tufting machine or pattern sections 11/12, each defining a separate tufting zone 13 in which different tufted fabrics or patterns can be formed. The tufting machine 10 operating the system of the present invention can be particularly adapted to the formation of carpet tiles and custom sized rugs and other carpet or fabric products having reduced or narrower sizes/widths.

Figure 2:
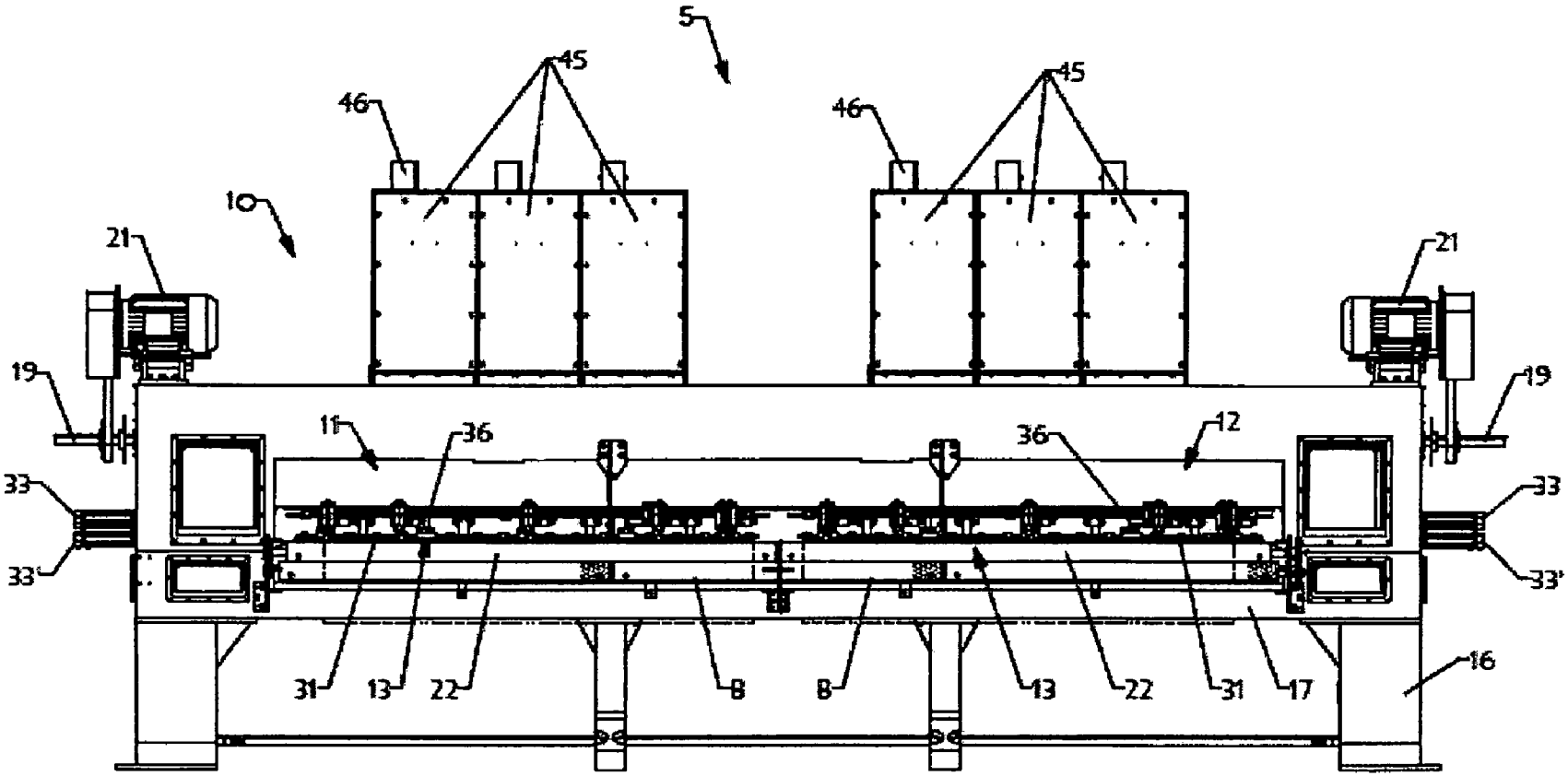
FIG. 2 is a side elevational view of the tufting machine of FIG. 1.
Figure 3:
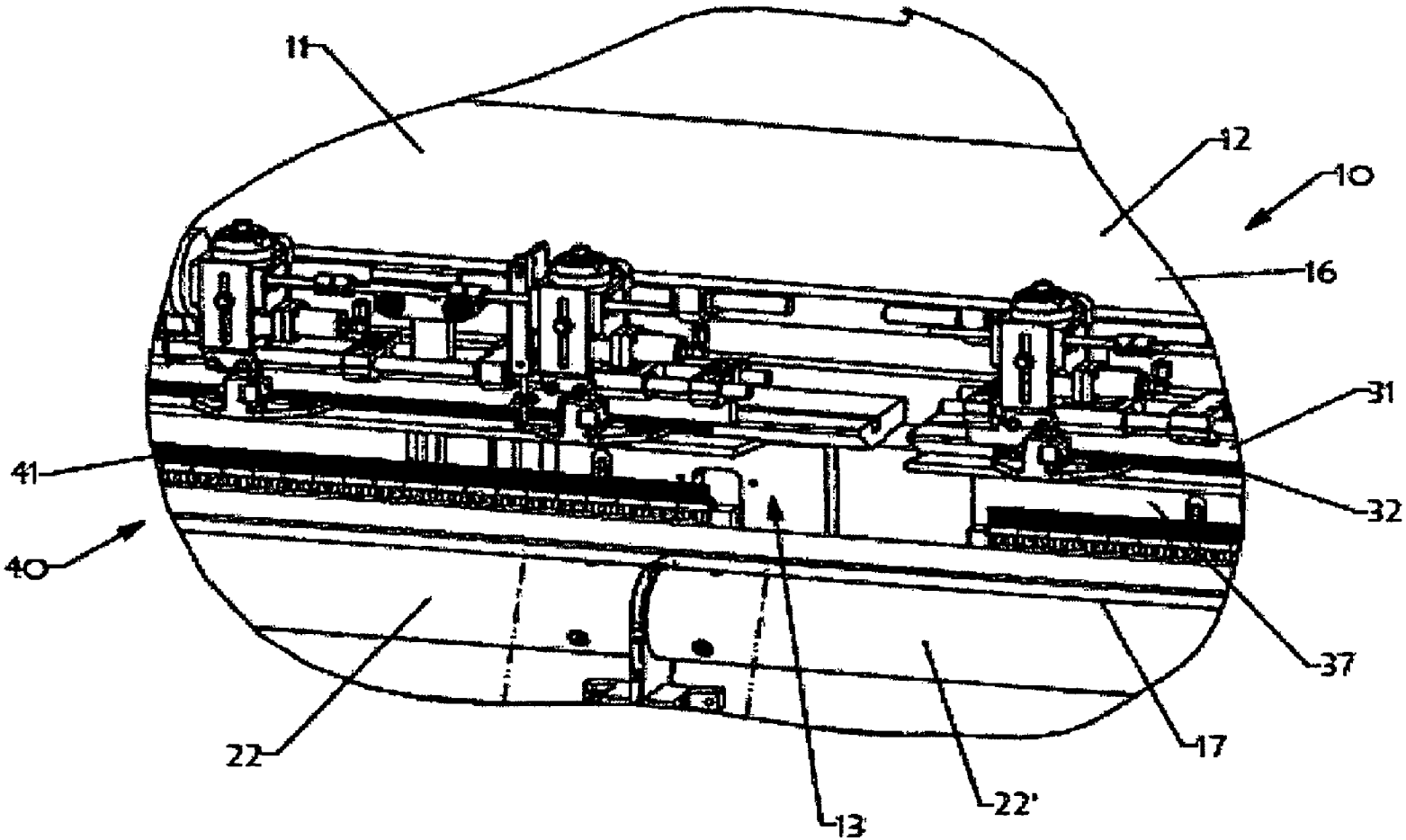
FIG. 3 is a perspective detailed view showing the split shiftable needle bars in the tufting machine as illustrated in FIGS. 1-2.
Figure 4:
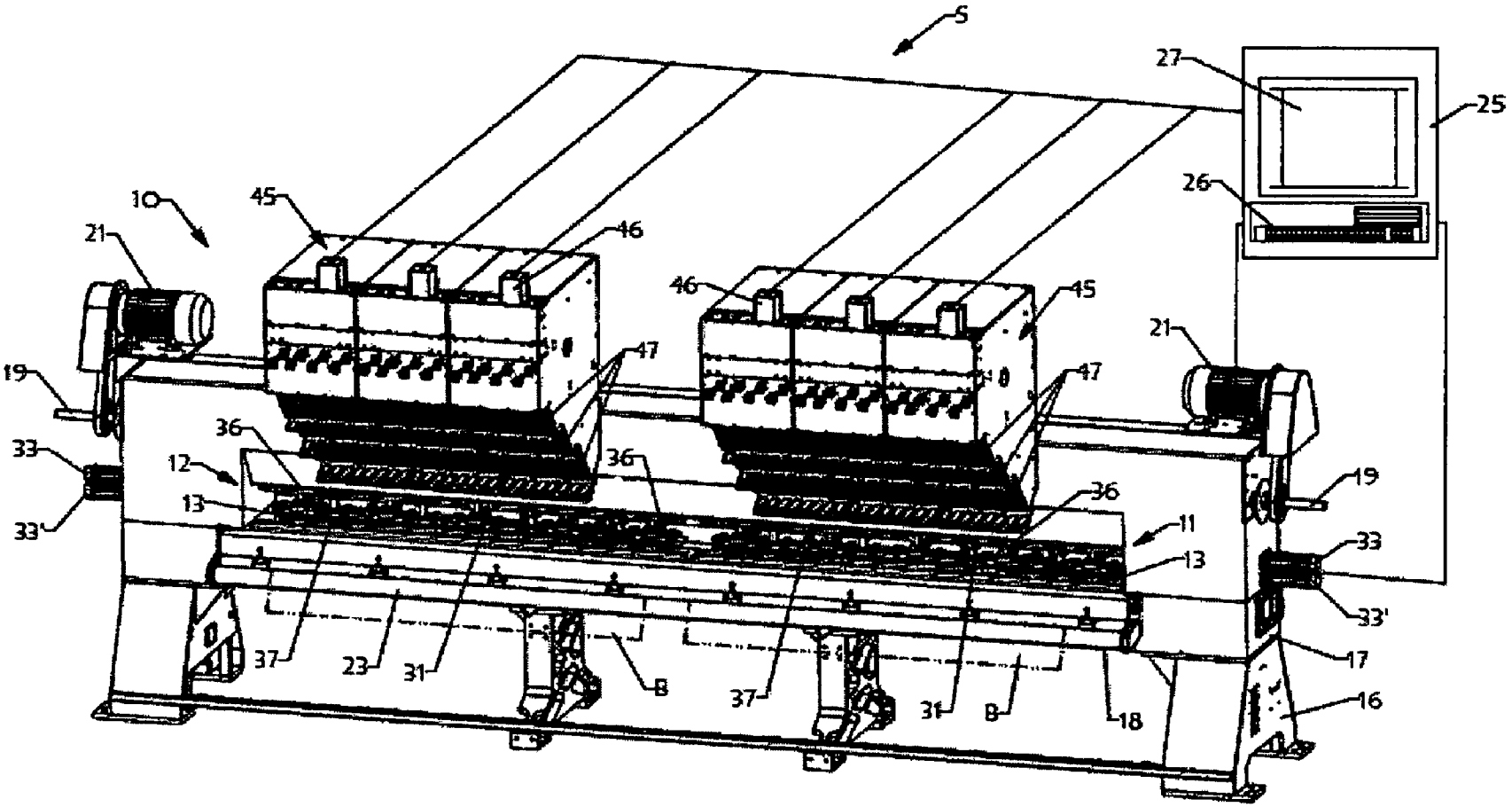
FIG. 4 is a perspective illustration of the rear side of the tufting machine for forming multiple tufted fabrics according to the principles of the present invention.
Figure 5:
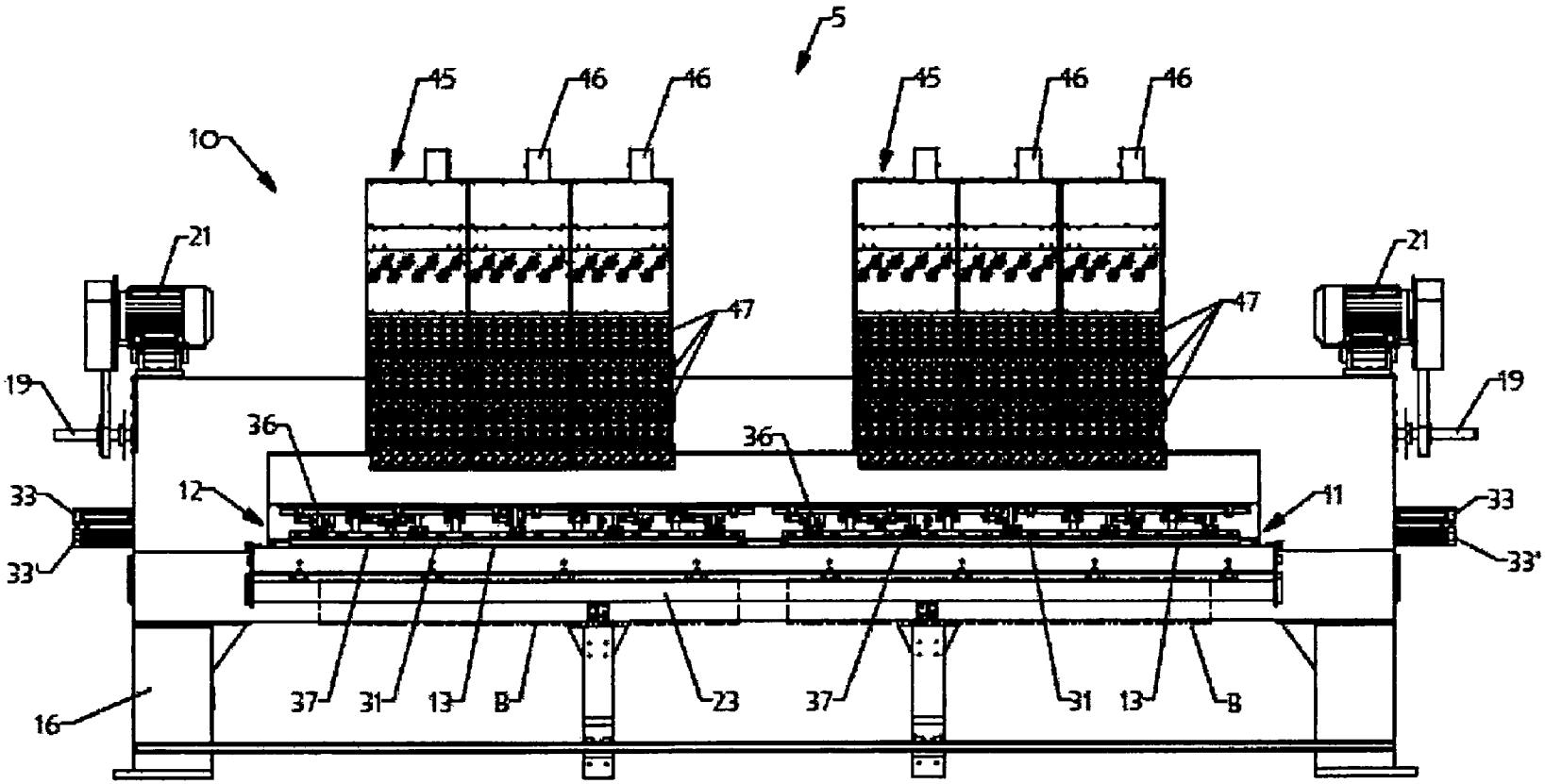
FIG. 5 is a side elevational view of the tufting machine of FIGS. 1 and 4.

As illustrated in FIGS. 1-6, the tufting machine 10 generally will include a frame 16 having an upstream side 17 (FIGS. 1-2) and a downstream side 18 (FIGS. 4-5), and typically will include at least one main drive shaft 19 driven by one or more drive motors for driving various operative elements or systems of the tufting machine sections 11/12, such as the needle bars and looper assemblies thereof. For example, as indicated in FIG. 2, each machine section 11/12 can have a separate main drive shaft 19. A backing material B (shown in phantom in FIGS. 1-2 and 4-5) will be fed by a series of backing feed rolls 22 (FIGS. 1-2) and 23 (FIGS. 4-5) arranged at the upstream and downstream sides thereof through the different tufting zones B defined by the machine or pattern sections of the tufting machine. It will be understood that a single backing material B can be fed through the tufting zones of the multiple machine sections, as indicated in FIGS. 4-5, with the backing material extending substantially across the width of the entire tufting machine, or multiple, separate backing material webs or sheets B-B1 (FIG. 1-2) of reduced widths can be fed through the tufting machine, with each separate backing material web being fed by a separate set of backing feed rolls 22/22' through their associated tufting zones 13 of the machine sections of the tufting machine as indicated in FIGS. 1-2.

The operation of each of the machine sections of the tufting machine typically can be controlled by a system control 25 (FIGS. 1 and 4). The system control can include or be part of an overall or master tufting machine control, such as one or more Command Performance™ computer control systems for tufting machines as manufactured by Card-Monroe Corp. that can be programmed with various pattern parameters for the different tufted fabrics to be produced by each machine section, and thus can directly monitor and control the operations of the different sections of the tufting machine via communication with the tufting machine controller(s) therefore. Alternatively, the system control 25 can be a separate control system, i.e., part of the overall plant control system or a separate, stand-alone controller that can control the operation of the different machine sections of the tufting machine in response to the programmed pattern instructions for the desired patterns in the fabrics being formed by each tufting machine section.

Additionally, the system control 25 can be provided with design center functionality to enable designing and inputting of patterns to be formed by each tufting machine or pattern section 11/12 directly to the system control as needed for controlling the different machine sections of the tufting machine. Alternatively, a design center can be linked to the system control, such that pattern information developed/designed in the design center can be downloaded directly to the system control from the design center. The system control typically can be provided with an input mechanism 26 such as a keyboard, mouse, etc., and a display or monitor 27, and will be in communication with the operative elements of the tufting machine to provide feedback from the monitoring of the various operative elements of the tufting machine. The system control further can be provided with the functionality to calculate and revise various parameters of the programmed pattern designs being run by each of the machine sections, such as yarn feed rates, pile heights, stitch lengths, backing feed rates, adjustments to the stroke of the needle bar, and adjustments to the bedrail of the tufting machine, as needed to form the desired patterns.

As noted previously, and as shown in FIGS. 1-6, the tufting machine 10 generally can be divided into two or more machine segments or pattern sections 11/12 for forming two or more tufted fabrics or articles. Although two separate tufting machine sections are shown in the drawings, it is contemplated that additional machine sections also can be formed or provided, depending upon the width of the products being produced and the footprint of the tufting machine. Each of the tufting machine sections accordingly generally will include one to two needle bars 31, each carrying a series of needles 32 (FIGS. 3 and 6) therealong. Each of the needle bars typically will be of a length up to approximately one half the width of the tufting machine 10 such as for tufting machines with two machine sections, or less for tufting machines with additional machine sections and/or tufting zones.

The needles of each of the needle bars will be mounted in spaced series along their respective needle bars and can be arranged in-line or can be staggered along a single or multiple needle bars. As indicated in FIGS. 1-2 and 4-5, the needle bars further can be shiftable needle bars that are shifted transversely across the width of their respective or associated tufting zones by computer controlled shift mechanism 33, such as a SmartStep™ shift mechanism as manufactured by Card-Monroe Corp., under control of the system control. Each needle bar or pair of needle bars also can have a separate shift mechanism 33/33' associated therewith as indicated in FIGS. 1-2 and 4-5. For example, for two machine sections, each including two needle bars, there can be four shift mechanisms, one for each of the different needle bars. Still further, it will be understood by those skilled in the art that other shift mechanisms such as pneumatic or hydraulically operated, motor driven, or cam driven shift mechanisms also can be used.

As further illustrated in FIGS. 2-3 and 5-6, each of the needle bars 31 generally is driven off of the main drive shaft by a drive arrangement or mechanism, including a series of push rods 36 that are driven by one or more drive shafts or line shafts that are tied to the main drive shaft, either directly or indirectly through gear mechanisms such as gear reducers. Alternatively, each of the drive shafts further can be driven by separate servo motors under control of the system controller. The stroke of the needle bars 31 (FIGS. 1-2 and 4-5) of each of the tufting machine sections 11/12 further can be adjusted, either manually or automatically through programming of the system control to provide varying needle strokes and/or pile heights for the tufted fabrics being formed by each of the different tufting machine sections.

Figure 6:
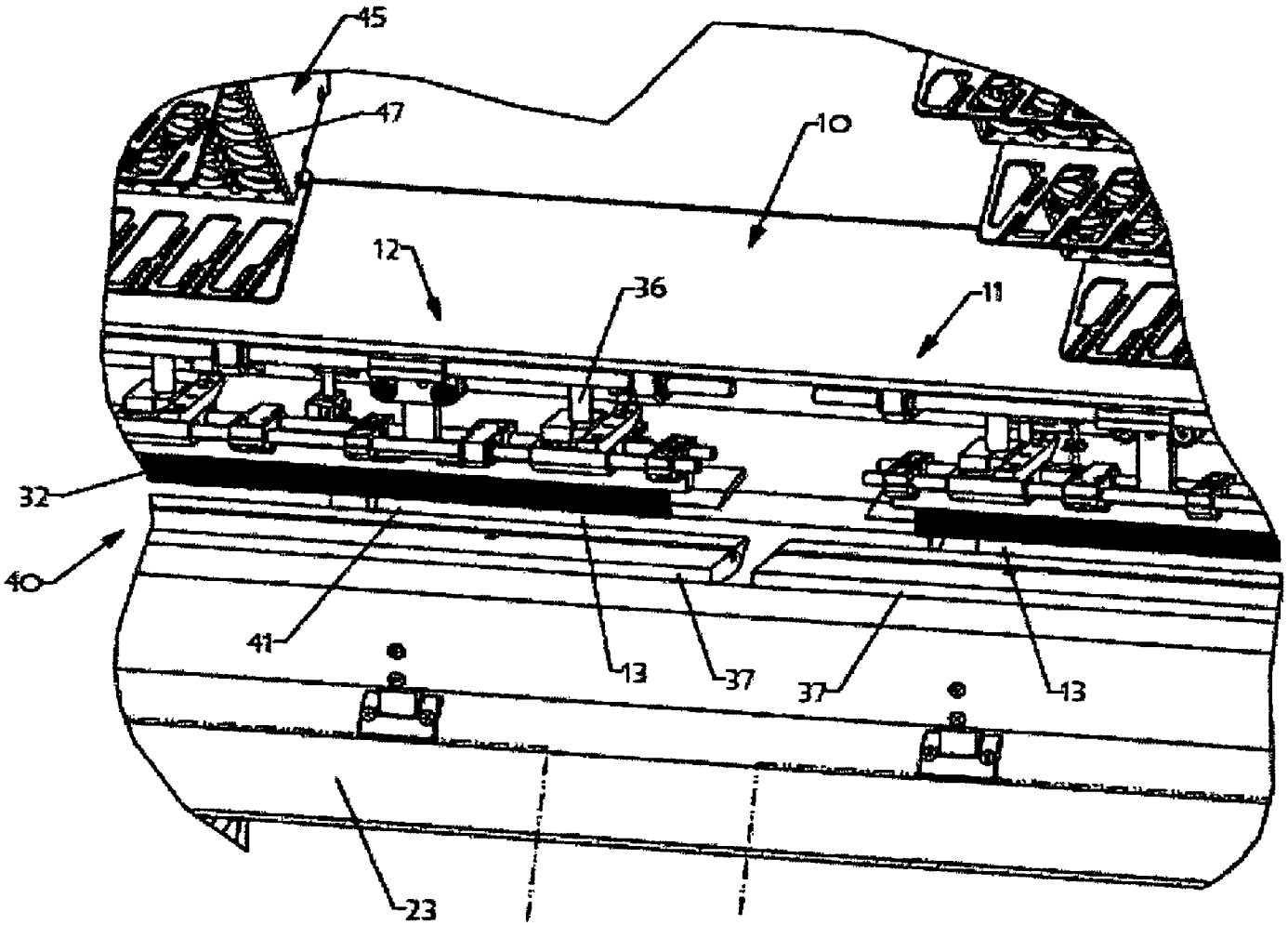
FIG. 6 is a cut-away view illustrating the needle bars and drive system of the tufting machine as illustrated in FIGS. 1-2 and 4-5.

As further indicated in FIGS. 3 and 6, each of the tufting machine sections also generally includes an adjustable bedrail section 37. Each bedrail section can be separately or independently adjusted by the system control according to the programmed pattern parameters for the pattern being produced by such tufting machine or pattern section as needed to form varying pile heights. Still further, a looper or hook assembly 40 generally will be provided beneath each adjustable bedrail sections of each separate tufting machine section. Each tufting machine section looper or hook assembly 40 can include a series of loop pile loopers 41, as shown in FIGS. 3 and 6, or also can include cut pile hooks, level cut loopers or hooks, clips, cut pile hooks with clips, and/or combinations thereof as well as other looper, hook or gauge part arrangements. Each of the tufting machine sections generally will include a particular arrangement of loopers, hooks, level cut loopers or hooks, etc. arranged along the upstream and/or downstream sides of the tufting zones thereof, as needed for forming the desired or programmed patterns (i.e., cut and loop, level cut loop, all cut, all loop, etc.) being run by each particular tufting machine section.

As additionally shown in FIGS. 2-3 and 5-6, the tufting machine of the present invention will include a set of one or more yarn feed mechanisms 45 for each of the tufting machine sections. The yarn feed mechanisms 45 can include a variety of different yarn feed mechanisms, including scroll or roll yarn feed systems, single or double end yarn feed systems such as an Infinity™ or an Infinity IIE™ system manufactured by Card-Monroe Corp., as indicated in the drawings, or other motor driven yarn feed systems adapted to feed yarns, such as a Yarntronics™ or a Quickthread™ attachment or yarn feed system, as manufactured by Card-Monroe Corp. Additionally, yarn feed systems with tube banks also can be used, such as disclosed in U.S. Pat. No. 7,096,806, the disclosure of which is incorporated by reference as if set forth fully herein.

Each of the yarn feed mechanisms can be controlled by a separate series of yarn feed controllers 46 (FIGS. 4-5) associated therewith, which yarn feed controllers control a series of yarn feed motors 47 driving yarn feed rolls 48 in order to feed the yarns to their associated needles as needed according to the programmed pattern steps for the patterns being formed by each of the tufting machine sections 11/12. The processors of the yarn feed controllers 46 in each yarn feed mechanism 45 generally will be electrically connected to the system control either directly or through a tufting machine control(s) for the tufting machine sections to provide feedback from the motors and to receive pattern control instructions from the system control 25 (FIGS. 1 and 4) to control operation of the yarn feed motors for feeding of the yarns to the needles of the tufting machine sections as needed to form the desired patterns.

Figure 7:
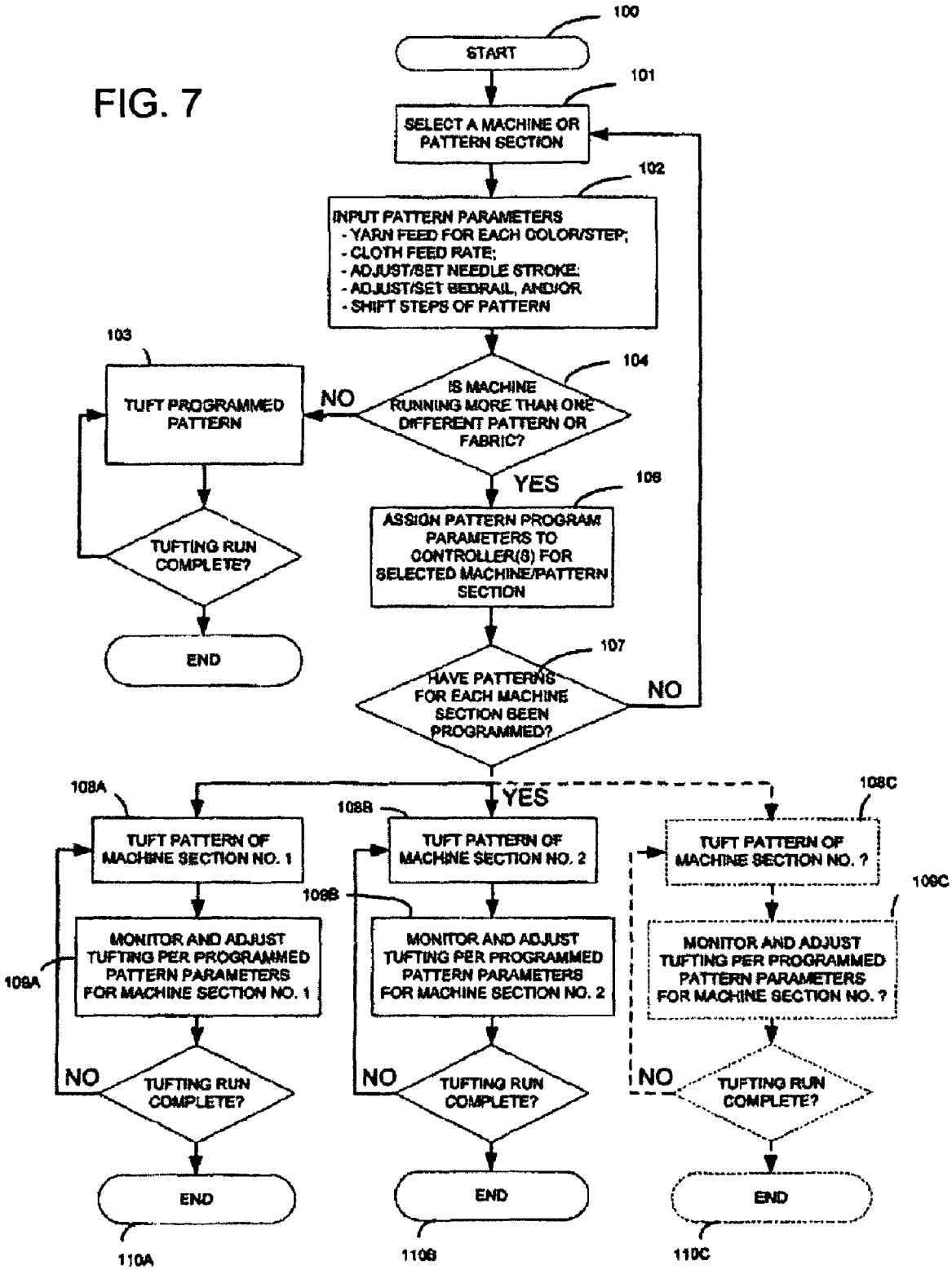
FIG. 7 is a flow chart schematically illustrating one embodiment of the method of operation of the system of the present invention for forming multiple tufted fabrics on a single tufting machine.

As indicated in FIG. 7, in operation of the system for forming multiple tufted fabrics according to the principles of the present invention, an operator will start (Step 100) the operation of the tufting machine having multiple sections for forming multiple different fabrics substantially simultaneously, and initially will select a machine or pattern section for the tufting machine for input of various different tufting parameters of a desired pattern to be formed by that tufting machine section (Step 101). The operator then will input the desired pattern parameters, including but not limited to, yarn feeds for each color or step of the pattern for the selected machine section, the cloth feed rate(s), the adjustment of the needle stroke, adjustment to the bedrail height and/or add shift steps for the pattern being produced, as indicated at 102. If only one tufting pattern is being produced, for example if the tufting machine sections are being operated in unison as a single tufting machine, the tufting machine then can be engaged and operated to tuft the programmed pattern until the tufting run has been completed (Step 103). However, for operation of the tufting machine where different patterned fabrics are being formed by each of the machine or pattern sections (Step 104), the programmed pattern parameters will be assigned to the tufting machine section control and/or yarn feed controllers for the selected tufting machine section either by the operator or automatically by the system control (Step 106). Thereafter, as noted at 107, the operator will select a next tufting machine section or pattern section and repeat the process for the input the pattern parameters for the pattern to be formed thereby.

Once the patterns for each of the tufting machine sections have been programmed, the operation of the tufting machine can be started, as indicated at 108A-108C. During operation of the tufting machine, the system controller and/or the tufting machine controls, will monitor and control the various operative elements of each of the tufting machine sections (Step 109 A-C), including operation of the yarn feed mechanisms, needle bars, needle bar shifters, as well as the backing feed rolls, as needed to tuft the programmed patterns. Formation of the different tufted patterns, and thus the different tufted fabrics, generally can be carried out substantially simultaneously, with the separate sections of the tufting machine each effectively functioning as a separate tufting machine under the control of the master system control.

Once the tufting operations are completed (Step 110 A-C), the operations of one or more, or all, of the machine or pattern sections of the tufting machine can be ceased. Alternatively, the tufting machine can be programmed to run multiple different patterns in each of the different tufting machine sections, and thus, depending upon the change-out of colors and other parameters, the tufting machine sections can be operated to run different patterns as part of continuing operation of the tufting machine. As a further alternative, one or more of the tufting machine sections can be temporarily taken out of operation while the other section(s) continues to form its programmed tufted/patterned fabric. For example, one machine section can be programmed to run a first desired pattern length or run, and can be stopped while another machine section can be run for a second, longer or shorter pattern length independently of the pattern run by the first section so as to continue running a desired pattern length as needed after the other one or more machine sections have been stopped.

Accordingly, it can be seen that the present invention provides a system and method for forming multiple different types of tufted fabrics having different patterns on the same tufting machine. Effectively, the present invention enables the operation and operative elements of multiple (i.e. 2 or more) tufting machines, such as needle bars, backing feed rolls, looper or hook assemblies, etc. to be combined in a single tufting machine, with each machine section being independently operable as needed for forming the desired patterns. Thus, a single tufting machine can be provided that can be operated to form a single tufted pattern, operating as a conventional type tufting machine, or can be used to substantially simultaneously form multiple different tufted fabrics on one tufting machine so as to provide the tufting machine with significantly enhanced functionality. This enables the tufting machine to be provided with significantly more versatility and capabilities. For example, the tufting machine can not only be operated to run 1-2 or more different tufted articles at substantially the same time, it also is possible to run one or more of the machine sections while another machine section (s) is stopped or idle, such as during a creeling or threading set-up operation for such machine section.

It will be further understood by those skilled in the art that while the present invention has been described above with reference to preferred embodiments, numerous variations, modifications, and additions can be made thereto without departing from the spirit and scope of the present invention as set forth in the following claims.

What is claimed is:

1. A tufting machine for forming multiple tufted articles, comprising:

a machine frame;

a series of machine sections defined across said machine frame, each of said machine sections being operable independently to form a tufted article and comprising at least one needle bar carrying a series of spaced needles and at least one looper or hook assembly;

backing feed rolls arranged at upstream and downstream sides of said machine frame for feeding a backing material therethrough; and a system control communicating with each of said machine sections and adapted to control operation of said at least one needle bar and said looper or hook assembly of each of said machine sections independently of operation of other ones of said machine sections for substantially simultaneously forming the multiple tufted articles.

2. A tufting machine for forming multiple tufted articles, comprising:

a machine frame;

a series of machine sections defined across said machine frame, each of said machine sections being operable independently and comprising at least one needle bar carrying a series of spaced needles and at least one looper or hook assembly;

backing feed rolls arranged at upstream and downstream sides of said machine frame for feeding a backing material therethrough;

a system control communicating with each of said machine sections and adapted to control operation of said at least one needle bar and said looper or hook assembly of each of said machine sections independently for substantially simultaneously forming the multiple tufted articles; and wherein said backing feed rolls comprise multiple pairs of upstream and downstream backing feed rolls, each pair of backing rolls associated with one of said machine sections for feeding a separate web of backing material therethrough.

3. The tufting machine of claim 1 and wherein said backing feed rolls comprise an upstream roll and a downstream roll that feed a single web of the backing material through all of said machine sections.

4. The tufting machine of claim 1 and wherein said system control comprises an input device by which pattern parameters, including at least one of a yarn feed rate, backing feed rate, needle stroke, bedrail position, and shift steps, for a pattern to be formed by each of said machine sections are input to said system controller.

5. The tufting machine of claim 1 and wherein said series of machine sections comprises at least 2 independently operable machine sections.

6. The tufting machine of claim 1 and wherein each of said machine sections further comprises at least one yarn feed device controlled by said system control.

7. The tufting machine of claim 1 and wherein each of said machine sections further comprises a bedrail and a main drive shaft maintained and controlled by said system control.

8. The tufting machine of claim 1 and further comprising a single main drive shaft extending through each of said machine sections.

9. The tufting machine of claim 1 and wherein each of said machine sections further comprises at least one shift mechanism connected to its at least one needle bar for shifting said at least one needle bar transversely.

10. A method of tufting multiple patterned articles on a single tufting machine having a series of independently operable pattern sections, comprising:

a) selecting a pattern section of the series of pattern sections of the tufting machine;

b) inputting at least one pattern parameter from a pattern to be run by the selected pattern section;

c) assigning the at least one pattern parameter to the selected pattern section;

d) repeating steps a)-c) for each additional pattern section of the tufting machine to be run;

e) after pattern parameters have been input for each pattern section, operating the tufting machine, with each pattern section being independently operated as needed to tuft each desired patterned article being run by each of the pattern sections of the tufting machine.

11. The method of claim 10 and wherein inputting at least one pattern parameter comprises inputting at least one pattern parameter selected from the group comprising a yarn feed rate, backing feed rate, needle stroke, bedrail position, and shift steps, for a pattern to be formed by each of said machine sections.

12. The method of claim 10 and further comprising monitoring each pattern section being run by the tufting machine and adjusting the tufting operation of each pattern section to substantially match the at least one input pattern parameter therefore.

13. A method of tufting multiple patterned articles on a single tufting machine, comprising:

a) selecting a pattern section of the tufting machine;

b) inputting at least one pattern parameter from a pattern to be run by the selected pattern section;

c) assigning the at least one pattern parameter to the selected pattern section;

d) repeating steps a)-c) for each pattern section of the tufting machine to be run;

e) after pattern parameters have been input for each pattern section, operating the tufting machine, with each pattern section independently operated as needed to tuft each desired pattern being run by the pattern sections of the tufting machine; and feeding a separate backing material for each pattern section to form each desired pattern.

14. The method of claim 10 and further comprising feeding a single backing material through the tufting machine.

15. The method of claim 10 and wherein repeating steps a)-c) for each pattern section of the tufting machine to be run comprises operating at least one pattern section while at least one pattern section is idle.

* * * * *